US006737805B2

(12) United States Patent
Nakada et al.

(10) Patent No.: US 6,737,805 B2
(45) Date of Patent: May 18, 2004

(54) PLASMA DISPLAY DEVICE AND METHOD OF PRODUCING THE SAME

(75) Inventors: Satoshi Nakada, Kanagawa (JP); Kazuyuki Ejima, Kanagawa (JP); Hiroshi Mori, Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 10/167,396

(22) Filed: Jun. 13, 2002

(65) Prior Publication Data

US 2003/0030375 A1 Feb. 13, 2003

(30) Foreign Application Priority Data

Jun. 15, 2001 (JP) ..... P2001-181208

(51) Int. Cl.[7] ..... H01J 17/49
(52) U.S. Cl. ..... 313/582; 313/586
(58) Field of Search ..... 313/582–587, 313/495–497, 489, 586

(56) References Cited

U.S. PATENT DOCUMENTS 5,818,168 A * 10/1998 Ushifusa et al. ..... 313/582
6,248,603 B1 * 6/2001 Jones et al. ..... 438/14
6,281,621 B1 * 8/2001 Nakamoto et al. ..... 313/309

* cited by examiner

*Primary Examiner*—Sandra O'Shea
*Assistant Examiner*—Sumati Krishnan
(74) *Attorney, Agent, or Firm*—Rader, Fishman & Grauer PLLC; Ronald P. Kananen

(57) ABSTRACT

A plasma display device comprises a first panel provided with discharge sustaining electrodes and a dielectric layer on the inside thereof, and a second panel laminated on the first panel so as to form discharge spaces on the inside, wherein the dielectric layer comprises a silicon oxide layer having a density of not less than $6.1\times10^{22}$ atoms/cm$^3$. Preferably, the density of the silicon oxide layer is not less than $6.4\times10^{22}$ atoms/cm$^3$. Where a sputtering method is used as a method of forming the silicon oxide layer, the concentration of oxygen gas in an atmosphere gas introduced into the sputtering apparatus is controlled to be 5 to 30 vol % during film formation.

2 Claims, 1 Drawing Sheet

PLASMA DISPLAY DEVICE AND METHOD OF PRODUCING THE SAME

BACKGROUND OF THE INVENTION

The present invention relates to a plasma display device and a method of producing the same, and particularly to a plasma display device having a characteristic feature as to the material of a dielectric layer formed on a sustaining electrode, and a method of producing the same.

As image display devices to be used in place of the cathode ray tube (CRT) which is the main stream at present, a variety of plane surface type (flat panel type) display devices have been investigated. As such a plane surface type display device, there may be mentioned the liquid crystal display device (LCD), the electroluminescence display device (ELD) and the plasma display device (PDP). Among others, the plasma display device has the merits of comparative easiness in enlarging screen and angle of visibility, excellent resistance to environmental factors such as temperature, magnetism, vibration, long useful life and the like, and is expected to be applied to domestic wall-hung television sets and large size public information terminal equipments.

The plasma display device is a display device in which a voltage is impressed on discharge cells comprising a discharge gas comprised of a rare gas sealed in discharge spaces, and phosphor layers in the discharge cells are excited by ultraviolet rays generated based on glow discharge in the discharge gas to thereby achieve light emission. Namely, the individual discharge cells are driven by a principle similar to that of fluorescent lamps, and, generally, hundreds of thousands of discharge cells are aggregated to constitute a single display screen. The plasma display devices are classified largely into the direct current driving type (DC type) and the alternating current driving type (AC type) according to the system of impressing the voltage on the discharge cells, and both types have respective merits and demerits.

The AC type plasma display device is suitable for enhancing the fineness because the partition walls for partitioning the individual discharge cells in the display screen may be provided, for example, in stripes. Moreover, since the surfaces of the electrodes for discharge are covered with a dielectric layer, there is the merit that the electrodes are worn with difficulty and the useful life is long.

In the AC type plasma display device commercialized at present, a dielectric layer is formed on sustaining electrodes provided on the inside surface of a first substrate, and the dielectric layer is generally comprised of silicon oxide formed by printing a paste followed by firing. In the AC type plasma display device, electric charges are accumulated in the dielectric layer, and are discharged by impressing a reverse direction voltage on the sustaining electrodes, thereby generating a plasma.

However, in the AC type plasma display device in which the dielectric layer is formed by the paste printing method, there are problems as to lightness and light emission efficiency. To cope with this, there is proposed a method of forming the dielectric layer such as silicon oxide by a vacuum film forming method such as a sputtering method, an evaporation method, a chemical evaporation (CVD) method and the like.

However, in the AC type plasma display device according to the prior art in which the dielectric layer comprised of silicon oxide is formed by the vacuum film forming method, there is a problem of voltage resistance characteristic of the dielectric layer for display discharge resulting in occurrence of abnormal discharge. In addition, even if the abnormal discharge is not generated, there is a problem that the discharge becomes instable and reliability is low.

SUMMARY OF THE INVENTION

Accordingly, it is an object of the present invention to provide a plasma display device which is excellent in voltage resistance characteristic, in which abnormal discharge would not easily be generated even if the thickness of the dielectric layer is reduced, and which is excellent in discharge stability, durability and reliability, and a method of producing the same.

In accordance with one aspect of the present invention, there is provided a plasma display device comprising: a first panel provided with discharge sustaining electrodes and a dielectric layer on the inside thereof; and a second panel laminated on the first panel so as to form discharge spaces on the inside, wherein the dielectric layer comprises a silicon oxide layer having a density of not less than $6.1\times10^{22}$ atoms/cm$^3$.

Preferably, the density of the silicon oxide layer is not less than $6.4\times10^{22}$ atoms/cm$^3$. The upper limit of the density of the silicon oxide layer is not particularly limited, and a higher density is more preferable; the density of quartz crystal is the upper limit.

In the present invention, the dielectric layer is preferably comprised of a single silicon oxide layer, but may have a multi-layer structure. In that case, it suffices that at least one layer in the multiple layers is the silicon oxide layer.

The thickness of the silicon oxide layer is not particularly limited, and is, generally, 1 to 20 $\mu$m, preferably, 1 to 10 $\mu$m.

The plasma display device according to the present invention is an alternating current driving type plasma display device, in which it is preferable that address electrodes, partition walls in a stripe form for partitioning discharge spaces, and phosphor layers disposed between the partition walls are provided on the inside of the second panel.

In the plasma display device according to the present invention, the dielectric layer has the silicon oxide layer having a density of not less than $6.1\times10^{22}$ atoms/cm$^3$, so that the voltage resistance characteristic of the dielectric layer is enhanced, abnormal discharge in the discharge spaces is prevented, and the durability and reliability of the device are enhanced.

In accordance with another aspect of the present invention, there is provided a method of producing a plasma display device comprising a first panel provided with discharge sustaining electrodes and a dielectric layer on the inside thereof, and a second panel laminated on the first panel so as to form discharge spaces on the inside, wherein a silicon oxide layer having a density of not less than $6.1\times10^{22}$ atoms/cm$^3$ is formed at the time of forming the dielectric layer.

The method of forming the silicon oxide layer having a density of not less than $6.1\times10^{22}$ atoms/cm$^3$ is not particularly limited, and examples of the method include a sputtering method, a chemical evaporation (CVD) method, an evaporation method and the like.

Where a sputtering method is used as the method of forming the silicon oxide layer, film formation by the sputtering method is preferably so carried out that the concentration of oxygen gas in the atmosphere gas introduced into the sputtering apparatus is 5 to 30 vol %. Where the volume ratio of oxygen is too low, it tends to be difficult to obtain a silicon oxide layer having a high density. On the other hand, where the volume ratio of oxygen is too high, it tends to be difficult to achieve film formation.

As the atmosphere gas, a gas containing an inert gas such as argon gas as a main component is used. Where the argon (Ar) gas is used as the inert gas, the volume concentration of oxygen ($O_2$) in the atmosphere gas is represented as $O_2/(Ar+O_2)$.

Where an evaporation method is used as the method of forming the silicon oxide layer, film formation by the evaporation method is preferably carried out while introducing not less than $1\times10^{-3}$ Pa of oxygen into the evaporation apparatus. When the quantity of oxygen introduced is too small, it tends to be difficult to obtain a silicon oxide layer having a high density. On the other hand, when too much oxygen is introduced, it is difficult to achieve evaporation by the evaporation method; therefore, the upper limit of the quantity of oxygen introduced is determined within the range in which evaporation is possible.

According to the present invention, a plasma display device can be realized which has a high voltage resistance characteristic, in which abnormal discharge would not easily be generated even if the thickness of the dielectric layer is decreased, and which is excellent in discharge stability, durability and reliability.

DETAILED DESCRIPTION OF THE PREFERRED EMBODIMENTS

Figure 1:
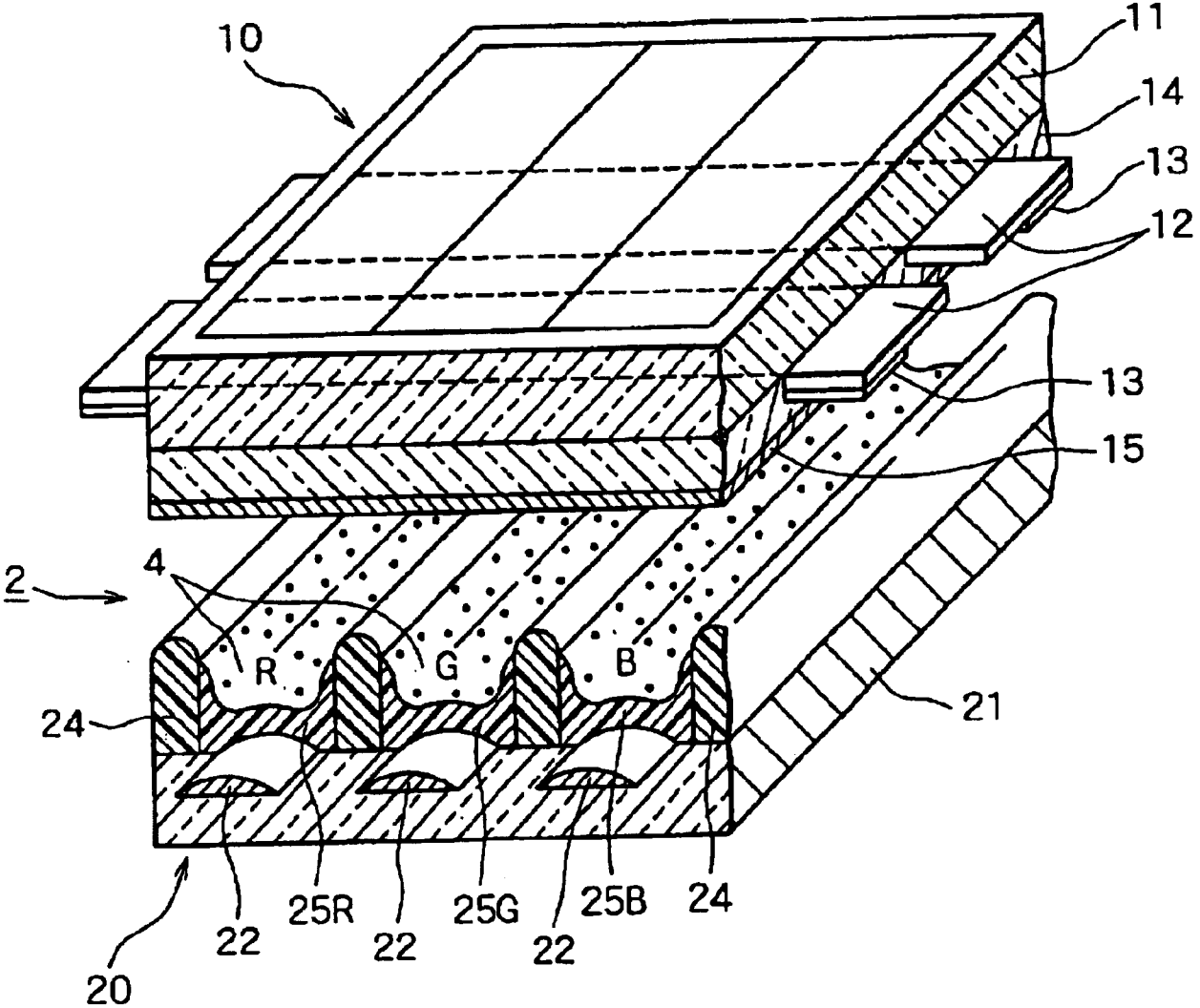
FIG. 1 is a general sectional view of a major part of a plasma display device according to one embodiment of the present invention.

Now, the present invention will be described below based on an embodiment shown in the drawing.

FIG. 1 is a general sectional view of a major part of a plasma display device according to one embodiment of the present invention.

Overall Constitution of the Plasma Display Device

First, based on FIG. 1, the overall constitution of an alternating current driving type (AC type) plasma display device (hereinafter it may be referred to simply as a plasma display device) will be described.

The AC type plasma display device 2 shown in FIG. 1 belongs to the so-called three-electrode type, in which electric discharge occurs between a pair of discharge sustaining electrodes 12. The AC type plasma display device 2 comprises a first panel 10 corresponding to a front panel, and a second panel 20 corresponding to a rear panel, which are laminated on each other. Light emission from phosphor layers 25R, 25G, 25B on the second panel 20 is observed, for example, through the first panel 10. Namely, the first panel 10 is on the display surface side.

The first panel 10 is comprised of a transparent first substrate 11, a plurality of pairs of discharge sustaining electrodes 12 provided in a stripe form on the first substrate 11 and composed of a transparent conductive material, bus electrodes 13 provided for lowering the impedance of the discharge sustaining electrodes 12 and composed of a material having an electrical resistivity lower than that of the discharge sustaining electrodes 12, a dielectric layer 14 provided on the first substrate 11 inclusive of the areas on the bus electrodes 13 and the discharge sustaining electrodes 12, and a protective layer 15 provided thereon. The protective layer 15 need not necessarily be provided, but is preferably provided.

On the other hand, the second panel 20 is comprised of a second substrate 21, a plurality of address electrodes (called also as data electrodes) 22 provided in a stripe form on the second substrate 21, a dielectric film (not shown) provided on the second substrate 21 inclusive of the areas on the address electrodes 22, insulating partition walls 24 extending in parallel with the address electrodes 22 on the dielectric film in the regions between the adjacent address electrodes 22, and a phosphor layer provided over the areas on the dielectric film and on side wall surfaces of the partition walls 24. The phosphor layer is comprised of a red phosphor layer 25R, a green phosphor layer 25G, and a blue phosphor layer 25B. Though not shown, the partition walls 24 may be provided in a lattice form.

FIG. 1 is a partly exploded perspective view of the display device, and, in practice, top portions of the partition walls 24 on the side of the second panel 20 make contact with the protective layer 15 on the side of the first panel 10. The region where a pair of the discharge sustaining electrodes 12 overlap with the address electrode 22 located between two partition walls 24 corresponds to a single discharge cell. In addition, a discharge gas is sealed in each discharge space 4 surrounded by the adjacent partition walls 24, the phosphor layers 25R, 25G, 25B and the protective layer 15. The first panel 10 and the second panel 20 are jointed to each other at peripheral areas thereof by use of frit glass.

The discharge gas sealed in the discharge spaces 4 is not particularly limited, and may be an inert gas such as xenon (Xe) gas, neon (Ne) gas, helium (He) gas, argon (Ar) gas and nitrogen ($N_2$) gas or a mixed gas of these inert gases. The total pressure of the discharge gas thus sealed in is not particularly limited, and is about $6\times10^3$ Pa to $8\times10^4$ Pa.

The direction in which the projection images of the discharge sustaining electrodes 12 extend and the direction in which the projection images of the address electrodes 22 extend are roughly orthogonal (not necessarily orthogonal, though), and the region where one pair of the discharge sustaining electrodes 12 overlap with one set of the phosphor layers 25R, 25G, 25B emitting light in three primary colors corresponds to one pixel. Since glow discharge is generated between one pair of the discharge sustaining electrodes 12, this type of plasma display device is called the "planar discharge type". Immediately before impressing a voltage on one pair of the discharge sustaining electrodes 12, for example, a panel voltage lower than the discharge start voltage of the discharge cell is impressed on the address electrode 22, whereby wall charges are accumulated in the discharge cell (selection of discharge cells for display), and the apparent discharge start voltage is lowered. Next, the discharge started between the pair of the discharge sustaining electrodes 12 can be sustained at a voltage lower than the discharge start voltage. In the discharge cell, the phosphor layers excited by irradiation with vacuum ultraviolet rays generated based on the glow discharge in the discharge gas emit light in peculiar colors according to the kinds of the phosphor layer materials. The vacuum ultraviolet rays having a wavelength according to the kind of the discharge gas sealed in the discharge space are generated.

The plasma display device 2 according to the present embodiment is a so-called reflection type plasma display device, in which light emission from the phosphor layers 25R, 25G, 25B is observed through the first panel 10. Therefore, the conductive material constituting the address electrodes 22 may be transparent or opaque, but the conductive material constituting the discharge sustaining electrodes 12 must be transparent. Here, the meanings of the terms "transparent" and "opaque" are based on the light transmission property of the conductive materials with respect to the light emission wavelengths (visible region) peculiar to the phosphor layer materials. Namely, the conductive materials constituting the discharge sustaining electrodes and the address electrodes can be said to be transparent if they are transparent to the lights emitted from the phosphor layers.

As an opaque conductive material, there may be used such materials as Ni, Al, Au, Ag, Pd/Ag, Cr, Ta, Cu, Ba, $LaB_6$, and $Ca_{0.2}La_{0.8}CrO_3$, either singly or in appropriate combination. As a transparent conductive material, there may be mentioned ITO (indium tin oxide) and $SnO_2$. The discharge sustaining electrodes 12 or the address electrodes 22 may be formed by a sputtering method, an evaporation method, a screen printing method, a sandblasting method, a plating method, a lift-off method or the like. The electrode width of the discharge sustaining electrodes 12 is not particularly limited, and is about 200 to 400 $\mu$m. The distance between the pair of the discharge sustaining electrodes 12 is not particularly limited, and is preferably about 5 to 150 $\mu$m. The width of the address electrodes 22 is, for example, about 50 to 100 $\mu$m.

The bus electrodes 13, typically, can be composed of a single-layer metallic film of a metallic material, for example, Ag, Au, Al, Ni, Cu, Mo, Cr or the like, or a laminate film of Cr/Cu/Cr or the like. In the reflection type plasma display device, the bus electrodes 13 composed of such a metallic material reduce the quantity of visible light radiated from the phosphor layers and transmitted through the first substrate 11, and may cause a reduction in the luminance of the display screen. Therefore, the width of the bus electrodes 13 is preferably as small as possible in the range where the electric resistance required of the entire part of the discharge sustaining electrodes can be obtained. In concrete, the electrode width of the bus electrodes 13 is smaller than that of the discharge sustaining electrodes 12, and is, for example, about 30 to 200 $\mu$m. The bus electrodes 13 can be formed by a sputtering method, an evaporation method, a screen printing method, a sandblasting method, a plating method, a lift-off method or the like.

The dielectric layer 14 formed on the surfaces of the discharge sustaining electrodes 12, in the present embodiment, is composed of a single silicon oxide layer, and has a density of not less than $6.1\times10^{22}$ atoms/cm$^3$. The dielectric layer 14 composed of the silicon oxide layer, in the present embodiment, is formed by a sputtering method, as will be described later. The thickness of the dielectric layer 14 is not particularly limited, and is 1 to 10 $\mu$m in the present invention.

By providing the dielectric layer 14, the ions and electrons generated in the discharge spaces 4 can be prevented from making direct contact with the discharge sustaining electrodes 12. As a result, wearing of the discharge sustaining electrodes 12 can be prevented. The dielectric layer 14 has the function of accumulating the wall charges generated in addressing periods, the function as a resistor for restricting an excessive discharge current, and a memory function for sustaining the discharge condition.

The protective layer 15 formed on the surface of the dielectric layer 14 on the discharge space side displays the action of preventing the direct contact of the ions and electrons with the discharge sustaining electrodes 12. As a result, wearing of the discharge sustaining electrodes 12 can be prevented effectively. In addition, the protective layer 15 also has the function of emitting secondary electrons necessary for discharge. As examples of the material for constituting the protective layer 15, there may be mentioned magnesium oxide (MgO), magnesium fluoride ($MgF_2$) and calcium fluoride ($CaF_2$). Among others, magnesium oxide is a preferable material having such characteristic features as chemical stability, low sputtering ratio, high light transmittance at the light emission wavelengths of the phosphor layers, low discharge start voltage and the like. The protective layer 15 may have a laminate film structure composed of at least two materials selected from the group consisting of the above-mentioned materials.

As examples of the materials for constituting the first substrate 11 and the second substrate 21, there may be mentioned high strain point glass, soda glass ($Na_2O.CaO.SiO_2$), borosilicate glass ($Na_2O.B_2O_3.SiO_2$), forsterite ($2MgO.SiO_2$), and lead glass ($Na_2O.PbO.SiO_2$). The material constituting the first substrate 11 and the material constituting the second substrate 21 may be the same or different.

The phosphor layers 25R, 25G, 25B are, for example, composed of phosphor layer materials selected from the group consisting of phosphor layer materials which emit red light, phosphor layer materials which emit green light, and phosphor layer materials which emit blue light, and are provided on the upper side of the address electrodes 22. In the case where the plasma display device is for color display, in concrete, for example, a phosphor layer composed of the phosphor layer material which emits red light (red phosphor layer 25R) is provided on the upper side of the address electrodes 22, a phosphor layer composed of the phosphor layer material which emits green light (green phosphor layer 25G) is provided on the upper side of other address electrodes 22, a phosphor layer composed of the phosphor layer material which emits blue light (blue phosphor layer 25B) is provided on the upper side of still other address electrodes 22, and a set of the phosphor layers for emitting light in three primary colors is provided in a predetermined sequence. As has been described above, the region where one pair of the discharge sustaining electrodes 12 overlap with one set of the phosphor layers 25R, 25G, 25B for emitting light in three primary colors corresponds to one pixel. The red phosphor layer, the green phosphor layer and the blue phosphor layer may be formed in a stripe form or in a lattice form.

As the phosphor layer materials for constituting the phosphor layers 25R, 25G, 25B, those phosphor layer materials which are high in quantum efficiency and low in saturation with respect to vacuum ultraviolet rays can be appropriately selected from the known phosphor layer materials and be used. Where color display is presumed, it is preferable to combine those phosphor layer materials which have color purity similar to the three primary colors specified by NTSC, which give a good white balance upon mixing of three primary colors, which have short afterglow times, and in which the afterglow times of the three primary colors are substantially equal.

Concrete examples of the phosphor layer materials will be given below. As examples of the phosphor layer material which emits red light, there may be mentioned ($Y_2O_3$:Eu), ($YBO_3$Eu), ($YVO_4$:Eu), ($Y_{0.96}P_{0.60}V_{0.40}O_4$:$Eu_{0.04}$), [(Y,Gd)$BO_3$:Eu], ($GdBO_3$:Eu), ($ScBO_3$:Eu), and ($3.5MgO.0.5MgF_2.GeO_2$:Mn). As examples of the phosphor layer material which emits green light, there may be mentioned ($ZnSiO_2$:Mn), ($BaAl_{12}O_{19}$:Mn), ($BaMg_2Al_{16}O_{27}$:Mn), ($MgGa_2O_4$:Mn), ($YBO_3$:Tb), ($LuBO_3$:Tb), and ($Sr_4Si_3O_8Cl_4$:Eu). As examples of the phosphor layer material which emits blue light, there may be mentioned ($Y_2SiO_5$:Ce), ($CaWO_4$:Pb), $CaWO_4$, $YP_{0.85}V_{0.15}O_4$, ($BaMgAl_{14}O_{23}$:Eu), ($Sr_2P_2O_7$:Eu), and ($Sr_2P_2O_7$:Sn).

As a method of forming the phosphor layers 25R, 25G, 25B, there may be mentioned a thick film printing method, a method of spraying particles of the phosphor layers, a method of preliminarily applying a sticky material to the area where the phosphor layers are to be formed and adhering particles of the phosphor layers, a method of using photosensitive phosphor layer pastes and patterning the phosphor layers by exposure to light and development, and a method of forming the phosphor layers on the entire surface and thereafter removing unrequired portions of the phosphor layers by a sandblasting method.

The phosphor layers 25R, 25G, 25B may be formed directly on the address electrodes 22, or may be formed over the areas on the address electrodes 22 and on side wall surfaces of the partition walls 24. Or, the phosphor layers 25R, 25G, 25B may be formed on the dielectric film provided on the address electrodes 22, or may be formed over the areas on the dielectric film provided on the address electrodes 22 and on the side wall surfaces of the partition walls 24. Further, the phosphor layers 25R, 25G, 25B may be formed only on the side wall surfaces of the partition walls 24. As a material for constituting the dielectric film, there may be mentioned, for example, low melting point glass and $SiO_2$.

As has been described above, the partition walls 24 (ribs) extending in parallel with the address electrodes 22 are formed on the second substrate 21. The partition walls (ribs) 24 may have a meander structure. Where the dielectric film is formed on the second substrate 21 and the address electrodes 22, the partition walls 24 may in some cases be formed on the dielectric film. As a material for constituting the partition walls 24, conventionally known insulating materials may be used; for example, a material prepared by mixing a metallic oxide such as alumina into a low melting point glass which is widely used can be used. The partition walls 24, for example, have a width of not more than about 50 $\mu$m and a height of about 100 to 150 $\mu$m. The pitch interval of the partition walls 24 is, for example, about 100 to 400 $\mu$m.

As examples of the method of forming the partition walls 24, there may be mentioned a screen printing method, a sandblasting method, a dry film method, and a photosensitivity method. The dry film method is a method in which a photosensitive film is laminated on the substrate, the photosensitive film in the areas where the partition walls are to be formed is removed by exposure to light and development, a partition wall forming material is embedded in the opening portions generated by the removal of the photosensitive film, and firing is conducted. The photosensitive film is fired and removed by the firing, and the partition wall forming material embedded in the opening portions is left, to be the partition walls 24. The photosensitivity method is a method in which a photosensitive material layer for forming the partition walls is formed on the substrate, the material layer is patterned by exposure to light and development, and then firing is conducted. The partition walls 24 may be blackened to form a so-called black matrix, whereby an increase in the contrast of the display screen can be contrived. As an example of the method of blackening the partition walls 24, there may be mentioned a method of forming the partition walls by use of a color resist material colored in black.

One pair of the partition walls 24 formed on the second substrate 21, and the discharge sustaining electrodes 12, the address electrodes 22 and the phosphor layers 25R, 25G, 25B occupying the region surrounded by the pair of the partition walls 24 altogether constitute one discharge cell. A discharge gas consisting of a mixture gas is sealed in the inside of each discharge cell, more concretely, in the inside of each discharge space surrounded by the partition walls, and the phosphor layers 25R, 25G, 25B emit light upon irradiation thereof with ultraviolet rays generated based on the AC glow discharge generated in the discharge gas in the discharge spaces 4.

Method of Producing the Plasma Display Device

Next, a method of producing the plasma display device according to one embodiment of the present invention will be described. The first panel 10 can be produced by the following method. First, an ITO layer is formed by, for example, a sputtering method on the entire surface of the first substrate 11 composed of high strain point glass or soda glass, and the ITO layer is patterned into a stripe form by a photolithographic technique and an etching technique, whereby a plurality of pairs of discharge sustaining electrodes 12 are formed. The discharge sustaining electrodes 12 extend in a first direction.

Next, an aluminum film is formed, for example, by an evaporation method on the entire inside surface of the first substrate 11, and the aluminum film is patterned by a photolithographic technique and an etching technique, whereby bus electrodes 13 are formed along edge portions of each of the discharge sustaining electrodes 12. Thereafter, a dielectric layer 14 consisting of a silicon oxide layer is formed on the entire inside surface of the first substrate 11 provided with the bus electrodes 13.

In the present embodiment, a sputtering method is used at the time of forming the dielectric layer 14. In addition, in order to form a silicon oxide layer having a density of not less than $6.1\times10^{22}$ atoms/cm$^3$, the concentration ($O_2$/(Ar+$O_2$)) of oxygen ($O_2$) gas in the atmosphere gas (composed mainly of Ar gas) introduced into the sputtering apparatus is controlled to be 5 to 30 vol %. Where the volume ratio of oxygen is too low, it tends to be difficult to obtain a silicon oxide layer having a high density. On the other hand, where the volume ratio of oxygen is too high, it tends to be difficult to achieve film formation.

Next, a protective layer 15 composed of magnesium oxide (MgO) and having a thickness of 0.6 $\mu$m is formed on the dielectric layer 14 by an electron beam evaporation method. By the above operation steps, the first panel 10 can be completed.

The second panel 20 is produced by the following method. First, a silver paste is printed in a stripe form, for example, by a screen printing method on the second substrate 21 composed of high strain point glass or soda glass, and firing is conducted, to form the address electrodes 22. The address electrodes 22 extend in a second direction orthogonal to the first direction. Next, a low melting point glass paste layer is formed on the entire surface by a screen printing method, and the low melting point glass paste layer is fired, to form the dielectric film.

Thereafter, a low melting point glass paste is printed, for example, by a screen printing method on the dielectric film on the upper side of the regions between the adjacent address electrodes 22. Thereafter, the second substrate 21 is fired in a firing furnace, to form the partition walls 24. The firing (partition wall firing step) is conducted in air, and the firing temperature is about 560° C. The firing time is about two hours.

Next, phosphor layer slurries for three primary colors are sequentially printed between the partition walls 24 formed on the second substrate 21. Thereafter, the second substrate 21 is fired in a firing furnace, to form the phosphor layers 25R, 25G, 25B over the areas on the dielectric film between the partition walls 24 and on the side wall surfaces of the partition walls 24. The firing (phosphor firing step) is conducted in air, and the firing temperature is about 510° C. The firing time is about ten minutes.

Next, assembly of the plasma display device is carried out. Namely, first, a seal layer is formed on a peripheral edge portion of the second panel 20 by, for example, screen printing. Next, the first panel 10 and the second panel 20 are laminated on each other, followed by firing to harden the seal layer. Thereafter, the spaces formed between the first panel 10 and the second panel 20 are evacuated, a discharge gas is charged into the spaces, and the spaces are sealed off, to complete the plasma display device 2.

Now, one example of an AC glow discharge operation of the plasma display device constituted as above will be described. First, a panel voltage higher than the discharge start voltage Vbd is impressed for a short time on, for example, all the discharge sustaining electrodes 12 on one side. By this, glow discharge occurs, wall charges are generated due to dielectric polarization on the surface of the dielectric layer 14 in the vicinity of the discharge sustaining electrodes 12 on one side, and the wall charges are accumulated, whereby the apparent discharge start voltage is lowered. Thereafter, while impressing a voltage on the address electrodes 22, a voltage is impressed on the discharge sustaining electrodes 12 on one side contained in the discharge cells for non-display, whereby glow discharge is caused to occur between the address electrodes 22 and the discharge sustaining electrodes 12 on one side, and the accumulated wall charges are eliminated. The elimination discharge is sequentially performed at each of the address electrodes 22. On the other hand, no voltage is impressed on the discharge sustaining electrodes 12 on one side contained in the discharge cells for display. By this, the accumulation of the wall charges is maintained. Thereafter, a predetermined pulse voltage is impressed between all pairs of the discharge sustaining electrodes 12, whereby glow discharge is started between the pairs of the discharge sustaining electrodes 12 in the cells where the wall charges have been accumulated, and, in the discharge cells, the phosphor layers excited by irradiation with vacuum ultraviolet rays generated based on the glow discharge in the discharge gas in the discharge spaces emit light in peculiar colors according to the kinds of the phosphor layer materials. The phases of the discharge sustaining voltages impressed on the discharge sustaining electrodes on one side and the discharge sustaining electrodes on the other side are staggered from each other by one half of period, and the polarities of the electrodes are reversed according to the frequency of the AC.

In the plasma display device 2 and the method of producing the same according to the present invention, the dielectric layer 14 is composed of the silicon oxide layer having a density of not less than $6.1\times10^{22}$ atoms/cm$^3$, so that the voltage resistance characteristic of the dielectric layer 14 is enhanced, abnormal discharge in the discharge spaces 4 is prevented, and durability and reliability of the device 2 are enhanced.

Other Embodiments

The present invention is not limited to the embodiment described above, and various modifications are possible within the scope of the present invention.

For example, while the dielectric layer 14 composed of a single silicon oxide layer is formed by a sputtering method in the above embodiment, the film forming method is not limited in the present invention so long as the silicon oxide layer having a density of not less than $6.1\times10^{22}$ atoms/cm$^3$ can be formed, and may be an evaporation method, a CVD method or the like. Besides, in the present invention, the dielectric layer 14 need not necessarily be composed of the single silicon oxide layer, and may be constituted of a multi-layer film so long as at least one layer of the multiplicity of layers is a silicon oxide layer having a density of not less than $6.1\times10^{22}$ atoms/cm$^3$.

In addition, in the present invention, the concrete structure of the plasma display device is not limited to the embodiment shown in FIG. 1, and may be other structures. For example, while the so-called three-electrode type plasma display device has been shown as an example in the embodiment shown in FIG. 1, the plasma display device according to the present invention may be a so-called two-electrode type plasma display device. In that case, of the pairs of discharge sustaining electrodes, those on one side are formed on the first substrate, and those on the other side are formed on the second substrate. Besides, the projection images of the discharge sustaining electrodes on one side extend in a first direction, whereas the projection images of the discharge sustaining electrodes on the other side extend in a second direction (preferably, substantially orthogonal to the first direction), and the pairs of discharge sustaining electrodes are oppositely disposed so as to face each other. In the two-electrode type plasma display device, the term "address electrodes" in the description of the embodiment above may be read as "discharge sustaining electrodes on the other side", as required.

Besides, while the plasma display device according to the above embodiment is the so-called reflection type plasma display device in which the first panel 10 is on the display panel side, the plasma display device according to the present invention may be a so-called transmission type plasma display device. In that case, in the transmission type plasma display device, the light emission from the phosphor layers is observed through the second panel 20. Therefore, though the conductive material constituting the discharge sustaining electrodes may be either transparent or opaque, the address electrodes 22 which are provided on the second substrate 21 must be transparent.

EXAMPLES

Now, the present invention will be described further based on detailed examples, but the present invention is not limited to or by the examples.

Example 1

A first panel 10 was produced by the following method. First, an ITO layer was formed by, for example, a sputtering method on the entire surface of a first substrate 11 composed of high strain point glass or soda glass, and the ITO layer was patterned into a stripe form by a photolithographic technique and an etching technique, to form a plurality of pairs of discharge sustaining electrodes 12.

Next, an aluminum film was formed by, for example, an evaporation method on the entire inside surface of the first substrate 11, and the aluminum film was patterned by a photolithographic technique and an etching technique, to form bus electrodes 13 along edge portions of each of the discharge sustaining electrodes 12.

Thereafter, a dielectric layer 14 composed of a silicon oxide layer was formed on the entire inside surface of the first substrate 11 provided with the bus electrodes 13. In forming the dielectric layer 14, an RF sputtering method with an $SiO_2$ target was used, and the concentration ($O_2$/($Ar+O_2$)) of oxygen ($O_2$) gas in the atmosphere gas (Ar gas is a main component) introduced into the sputtering apparatus was controlled to be 20 vol %. The thickness of the silicon oxide layer was about 6 μm. The density of the silicon oxide layer was measured by the Rutherford backscattering analyzing method, and was found to be $6.48\times10^{22}$ atoms/$cm^3$, as shown in Table 1. The voltage resistance characteristic of the silicon oxide layer was examined, and was confirmed to be as high as 2.15 MV/cm.

Next, a protective layer 15 composed of magnesium oxide (MgO) and having a thickness of 0.6 μm was formed by an electron beam evaporation method on the dielectric layer 14 composed of the silicon oxide layer. By the above operation steps, the first panel 10 could be completed.

A second panel 20 was produced by the following method. First, a silver paste was printed in a stripe form by, for example, a screen printing method on a second substrate 21 composed of high strain point glass or soda glass, and firing was conducted, to form address electrodes 22. The address electrodes 22 extend in a second direction orthogonal to the first direction. Next, a low melting point glass paste layer was formed on the entire surface by a screen printing method, and the low melting point glass paste layer was fired, to form a dielectric film.

Thereafter, a low melting point glass paste was printed by, for example, a screen printing method on the dielectric film on the upper side of the regions between the adjacent address electrodes 22. Then, the second substrate 21 was fired in a firing furnace, to form partition walls 24. The firing (partition wall firing step) was conducted in air, the firing temperature was about 560° C., and the firing time was about two hours.

Next, phosphor layer slurries for three primary colors were sequentially printed on the areas between the partition walls 24 formed on the second substrate 21. Then, the second substrate 21 was fired in a firing furnace to form phosphor layers 25R, 25G, 25B over the areas on the dielectric film between the partition walls 24 and on side wall surfaces of the partition walls 24, and firing at 510° C. was conducted in air for ten minutes, to complete the second panel 20.

Next, assembly of a plasma display device was carried out. Namely, first, a seal layer was formed on a peripheral edge portion of the second panel 20 by screen printing. Next, the first panel 10 and the second panel 20 were laminated on each other, and firing was conducted to harden the seal layer. Thereafter, the spaces formed between the first panel 10 and the second panel 20 were evacuated, a discharge gas was charged into the spaces, and the spaces were sealed off, to complete the plasma display device 2.

The plasma display device 2 was subjected to an acceleration test in which the period of time until the luminance was lowered to ½ of the initial luminance (the luminance immediately after the start of the test) was measured. As shown in Table 1, a reliability of not less than 10000 hours was obtained. In addition, an acceleration test was conducted in which the period of time until plasma light emission became impossible under the same driving voltage was measured. As shown in Table 1, a reliability of not less than 10000 hours was obtained.

TABLE 1

| | Quantity of oxygen introduced during sputtering ($O_2$/Ar + $O_2$); vol % | Voltage resistance characteristic (MV/cm) | Dencity (× $10^{22}$atoms/$cm^3$) | Acceleration test luminance deterioration | Acceleration test driving voltage |
|---|---|---|---|---|---|
| Comp. Ex. 1 | 0% | 0.15 | 6.05 | ≦2000 hr | Tens to hundred |
| Example 3 | 6% | 0.25 | 6.11 | ≧5000 hr | ≧1000 hr |
| Example 2 | 10% | 1.05 | 6.29 | ≧8000 hr | ≧5000 hr |
| Example 1 | 20% | 2.15 | 6.48 | ≧10000 hr | ≧10000 hr |

Example 2

A plasma display device was assembled in the same manner as in Example 1 except that the concentration ($O_2$/(Ar+$O_2$)) of oxygen ($O_2$) gas in forming the silicon oxide layer constituting the dielectric layer 14 by the sputtering method was set at 10 vol %, and the plasma display device was subjected to the same tests as in Example 1. The results are shown in Table 1.

Example 3

A plasma display device was assembled in the same manner as in Example 1 except that the concentration ($O_2$/(Ar+$O_2$)) of oxygen ($O_2$) gas in forming the silicon oxide layer constituting the dielectric layer 14 by the sputtering method was set at 6 vol %, and the plasma display device was subjected to the same tests as in Example 1. The results are shown in Table 1.

Comparative Example 1

A plasma display device was assembled in the same manner as in Example 1 except that the concentration ($O_2$/(Ar+$O_2$)) of oxygen ($O_2$) gas in forming the silicon oxide layer constituting the dielectric layer 14 by the sputtering method was set at 0 vol %, and the plasma display device was subjected to the same tests as in Example 1. The results are shown in Table 1.

Example 4

A plasma display device was assembled in the same manner as in Example 1 except that the silicon oxide layer constituting the dielectric layer 14 was formed by a CVD method, and the plasma display device was subjected to the same tests as in Example 1. The results are shown in Table 2.

TABLE 2

| | Voltage resistance Characteristic (MV/cm) | Density ($\times 10^{22}$ atoms/$cm^3$) | Acceleration test luminance deterioration | Acceleration test driving voltage |
|---|---|---|---|---|
| Example 4 | 2.40 | 6.49 | ≧10000 hr | ≧10000 hr |

Example 5

A plasma display device was assembled in the same manner as in Example 1 except that the silicon oxide layer constituting the dielectric layer 14 was formed by an electron beam (EB) heating evaporation method with an $SiO_2$ target, and the evaporation was carried out while introducing $1\times10^{-2}$ Pa of oxygen into the film forming chamber during the evaporation.

Evaluation

As shown in Tables 1 and 2, it was confirmed that, in the case where the dielectric layer is composed of a silicon oxide layer having a density of not less than $6.1\times10^{22}$ atoms/$cm^3$, a plasma display device can be realized which has a high voltage resistance characteristic, in which abnormal discharge would not easily be generated even if the thickness of the dielectric layer is decreased, and which is excellent in discharge stability, durability and reliability.

Besides, as shown in Table 1, it was confirmed that, in the case where the concentration ($O_2/(Ar+O_2)$) of oxygen ($O_2$) gas in the atmosphere gas (Ar gas is a main component) introduced into the sputtering apparatus is not less than 5 vol %, a plasma display device can be produced which has a high voltage resistance characteristic, in which abnormal discharge would not easily be generated even if the thickness of the dielectric layer is decreased, and which is excellent in discharge stability, durability and reliability.

What is claimed is:

1. A plasma display device comprising:

a first panel provided with discharge sustaining electrodes and a dielectric layer on the inside thereof, and a second panel laminated on said first panel so as to form discharge spaces on the inside, wherein said dielectric layer comprises a silicon oxide layer having a density of not less than $6.1\times10^{22}$ atoms/$cm^3$, and wherein said plasma display device is an alternating current driving type plasma display device and address electrodes, partition walls in a stripe form or a lattice form for partitioning said discharge spaces, and a phosphor layer disposed between said partition walls are provided on the inside of said second panel.

2. A plasma display device as set forth in claim 1, wherein the density of said silicon oxide layer is not less than $6.4\times10^{22}$ atoms/$cm^3$.

* * * * *